US011976825B2

(12) United States Patent
Huang et al.

(10) Patent No.: US 11,976,825 B2
(45) Date of Patent: May 7, 2024

(54) AIR CONDITIONING SYSTEM AND METHOD FOR CONTROLLING SAME

(71) Applicant: GREE ELECTRIC APPLIANCES, INC. OF ZHUHAI, Guangdong (CN)

(72) Inventors: Haiwei Huang, Zhuhai (CN); Kai Wang, Zhuhai (CN); Fengqiang Huang, Zhuhai (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 170 days.

(21) Appl. No.: 17/049,929

(22) PCT Filed: Dec. 17, 2018

(86) PCT No.: PCT/CN2018/121542

§ 371 (c)(1),
(2) Date: Oct. 22, 2020

(87) PCT Pub. No.: WO2019/205667

PCT Pub. Date: Oct. 31, 2019

(65) Prior Publication Data

US 2021/0095868 A1 Apr. 1, 2021

(30) Foreign Application Priority Data

Apr. 23, 2018 (CN) ..... 201810368555.X

(51) Int. Cl.
*F24F 1/0041* (2019.01)
*F24F 11/74* (2018.01)
(Continued)

(52) U.S. Cl.
CPC ..... *F24F 1/0041* (2019.02); *F24F 11/74* (2018.01); *F24F 13/02* (2013.01); *F24F 2110/50* (2018.01)

(58) Field of Classification Search
CPC ..... F24F 1/0041; F24F 11/74; F24F 13/02; F24F 2110/50; F24F 3/147; F24F 13/068; F24F 13/14; F24F 13/10
See application file for complete search history.

(56) References Cited

U.S. PATENT DOCUMENTS 5,464,370 A * 11/1995 Shimizu ..... F24F 13/1406 454/341
2010/0297928 A1 11/2010 So

FOREIGN PATENT DOCUMENTS

CN 102072539 A 5/2011
CN 202131789 U 2/2012
(Continued)

OTHER PUBLICATIONS

English translation of JPH11182893A, dated Aug. 9, 2022 (Year: 2022).*

(Continued)

*Primary Examiner* — Vivek K Shirsat
*Assistant Examiner* — Brett Peterson Mallon
(74) *Attorney, Agent, or Firm* — J. Miguel Hernandez; James R. Gourley; Carstens, Allen & Gourley, LLP

(57) ABSTRACT

Air conditioning system and a method for controlling same. The air conditioning system is configured to carry out air conditioning in indoor space, and includes an indoor unit body. The indoor unit body includes a cavity and a heat exchanger arranged inside the cavity. The air conditioning system further includes at least one return air inlet connecting the indoor space to the cavity. The at least one return air inlet includes a first return air inlet, and the first return air inlet is located at a lower portion of the indoor space.

14 Claims, 2 Drawing Sheets

(51) Int. Cl.
*F24F 13/02* (2006.01)
*F24F 110/50* (2018.01)

(56) References Cited

FOREIGN PATENT DOCUMENTS

| | | | | |
|---|---|---|---|---|
| CN | 203550033 | U | | 4/2014 |
| CN | 204227550 | U | | 3/2015 |
| CN | 104748237 | A | * | 7/2015 |
| CN | 108644891 | A | | 10/2018 |
| CN | 208186578 | U | | 12/2018 |
| EP | 2853829 | A1 | | 4/2015 |
| JP | 3127146 | U | | 12/1991 |
| JP | H11182893 | A | * | 12/1991 |
| JP | 7-158899 | A | | 6/1995 |
| JP | H07158899 | A | * | 6/1995 |
| JP | 11-182893 | A | | 7/1999 |
| JP | H03127146 | U | * | 7/1999 |
| JP | 2007078254 | A | | 3/2007 |
| KR | 1020070041701 | A | | 4/2007 |
| KR | 1020090092109 | A | | 8/2009 |
| WO | 9313881 | A1 | | 7/1993 |
| WO | 2005026624 | A1 | | 3/2005 |

OTHER PUBLICATIONS

English translation of CN104748237A, dated Jan. 27, 2023 (Year: 2023).*
English translation of JPH07158899A, dated Aug. 9, 2022 (Year: 2022).*
Extended European Search Report for European Application No. 18916018.7 dated May 3, 2021 (7 pages).
International Search Report for Application No. PCT/CN2018/121542 dated Mar. 14, 2019 (3 pages).
English translation of Office Action for Korean Patent Application No. 10-2020-7033541 dated Nov. 25, 2022 (7 pages).
Office Action for Korean Patent Application No. 10-2020-7033541 dated Nov. 25, 2022 (6 pages).

* cited by examiner

AIR CONDITIONING SYSTEM AND METHOD FOR CONTROLLING SAME

The present application claims the priority benefit of Chinese Patent Application No. 201810368555.X, entitled "AIR CONDITIONING SYSTEM AND METHOD FOR CONTROLLING SAME" and filed on Apr. 23, 2018 in the China National Intellectual Property Administration, the content of which is hereby incorporated by reference herein for all purposes. This application is a national phase under 35 U.S.C. § 120 of international patent application PCT/CN2018/121542, entitled "AIR CONDITIONING SYSTEM AND METHOD FOR CONTROLLING SAME" filed on Dec. 17, 2018, the content of which is also hereby incorporated by reference.

TECHNICAL FIELD

The present disclosure relates to a field of air conditioning technology, and more particularly, to an air conditioning system and a method for controlling the same.

BACKGROUND

With a continuous improvement of a living standard, more and more families choose to install an air conditioner in a kitchen to improve kitchen environment and improve the cooking experience of a user. Because a large amount of cooking fume is generated in the kitchen, the cooking fume enters the air conditioner in the kitchen easily, which will affect a service life of the air conditioner in the kitchen. In view of this problem, a solution known to the inventors is usually providing a cooking fume filter system at a return air inlet of the air conditioner in the kitchen, such as providing a filter net at the return air inlet. In this case, the filter net needs to be replaced frequently, and a filtering effect of the filter net is poor, thus the cooking fume can still enter the air conditioner in the kitchen.

SUMMARY

The present disclosure provides an air conditioning system and a method for controlling the same to prevent cooking fume entering an indoor unit body.

In some embodiments, the present disclosure adopts following technical solutions.

An air conditioning system for air conditioning of indoor space is provided, including an indoor unit body. The indoor unit body includes a cavity and a heat exchanger provided in the cavity. The air conditioning system further includes at least one return air inlet connecting the indoor space to the cavity. The at least one return air inlet includes a first return air inlet. The indoor unit body is located in an upper part of the indoor space, and the first return air inlet is located at a lower part of the indoor space.

In some embodiments, the at least one return air inlet further includes a second return air inlet located in the upper part of the indoor space, and the air conditioning system further includes a first switch device. The first switch device connects the cavity to at least one of the first return air inlet and the second return air inlet.

In some embodiments, a cooking fume detection device is provided at the second return air inlet.

In some embodiments, the air conditioning system further includes the air conditioning system further comprises an exhaust duct, and the exhaust duct connects the second return air inlet to an outdoor space.

In some embodiments, the air conditioning system further includes an airflow driving device, and the airflow driving device drives air in the indoor space to be exhausted to the outdoor space through the second return air inlet and the exhaust duct.

In some embodiments, an air inlet is provided in a cavity wall of the cavity. The air conditioning system further includes an air duct structure communicating with the air inlet and the first return air inlet and the second return air inlet are arranged on the air duct structure.

In some embodiments, the air duct structure includes a main air duct portion connected to the indoor unit body and a plurality of branch air duct portions connected to the main air duct portion, and the first return air inlet and the second return air inlet are arranged on the branch air duct portion.

In some embodiments, the first switch device is disposed in an inner cavity of the main air duct portion; and/or, the plurality of branch air duct portions include a first branch air duct portion and a second branch air duct portion; the first return air inlet is arranged on the first branch air duct portion, and the second return air inlet is arranged on the second branch air duct portion.

In some embodiments, the first branch air duct portion and/or the second branch air duct portion are/is arranged to extend in a vertical direction.

In some embodiments, the first branch air duct portion is arranged inside a wall, and the first return air inlet is exposed outside the wall.

In some embodiments, the air conditioning system is configured for air conditioning in a kitchen. The first return air inlet is arranged on a cabinet in the kitchen or arranged on a wall close to a floor of the kitchen, and the second return air inlet is arranged on a ceiling of the kitchen or on a wall adjacent to the ceiling.

On another aspect, following technical solutions are adopted by the present disclosure.

A method for controlling the air conditioning system mentioned above is provided. A cooking fume detection device is provided at the second return air inlet, and the method includes:

controlling the first switch device to allow the cavity only to communicate with the first return air inlet when a detection value of the cooking fume detection device is greater than or equal to a predetermined value;

controlling the first switch device to allow the cavity to communicate only with the second return air inlet when a detection value of the cooking fume detection device is less than a predetermined value, and when the indoor unit body is operating for cooling;

controlling the first switch device to allow the cavity to communicate only with the first return air inlet when a detection value of the cooking fume detection device is less than a predetermined value, and when the indoor unit body is operating for heating.

In some embodiments, the method for controlling the air conditioning system includes:

opening the exhaust duct to allow the second return air inlet to communicate with the outdoor space when the detection value of the cooking fume detection device is greater than or equal to the predetermined value.

The air conditioning system provided in the present disclosure is provided with a first return air inlet located at the lower part of the indoor space. In this way, even if the cooking fume exists in the indoor space, the hot cooking fume is in the upper part of the indoor space. Air returning through the first return air inlet located at the lower part of the indoor space can effectively prevent the cooking fume from entering the indoor unit body, thereby ensuring the cleanliness of the indoor unit body and prolonging the service life of the air conditioning system.

BRIEF DESCRIPTION OF THE DRAWINGS

To make the foregoing and other objectives, features and advantages of the present disclosure clearer the embodiments of the present disclosure will be described with reference to accompanying drawings, in which.

DETAILED DESCRIPTION OF THE EMBODIMENTS

Figure 1:
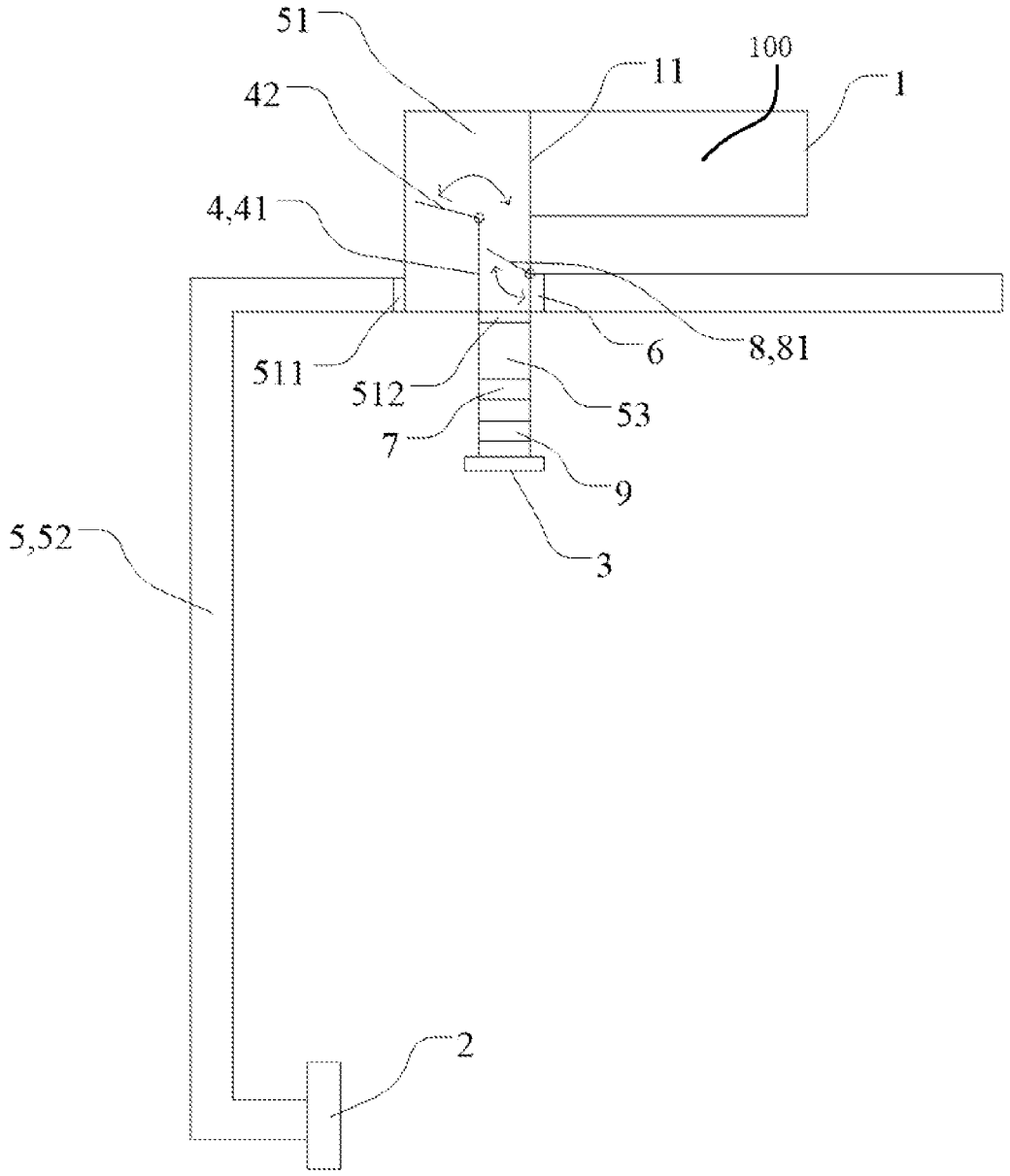
FIG. 1 is a schematic structural diagram illustrating an air conditioning system according to an embodiment of the present disclosure.

The present disclosure will be described below based on embodiments, but the present disclosure is not limited to these embodiments. In order to avoid obfuscating an essence of the present disclosure, known methods, processes, procedures and components are not described in detail.

In addition, those of ordinary skill in the art should understand that the drawings provided herein are illustrative and not necessarily drawn in scale.

Unless otherwise expressly indicated in the context, the words "including", "comprising" and the like in the entire description and the claims shall be construed as a meaning of containing rather than a meaning of exclusive or exhaustive; that is, it should be construed as a meaning of "including but not limited to".

In the description of the present disclosure, it should be understood that the terms "first", "second" and the like are used only for description, but not to be understood as indicating or implying relative importance. In addition, in the description of the disclosure, unless otherwise stated, a meaning of "plurality" is two or more in number.

The present disclosure provides an air conditioning system for air conditioning of indoor space, especially a space inside a kitchen. Of course, it may be understood that the air conditioning system is also applicable to other indoor spaces with a same air quality problem.

The air conditioning system includes an indoor unit body 1, which is configured to perform functions known to the inventors, such as cooling, heating, and dehumidification of an air conditioner. The indoor unit body 1 includes a cavity 100 and devices known to the inventors such as a heat exchanger and a fan arranged in the cavity 100. The air conditioning system also includes at least one return air inlet capable of connecting the indoor space to the cavity 100 and allowing air to return to the indoor unit body 1. The at least one return air inlet includes a first return air inlet 2, and the indoor unit body 1 is located in an upper part of the indoor space. It can be understood that the upper part herein includes a top area of the indoor space. The first return air inlet 2 is located at a lower part of the indoor space. It can be understood that the lower part herein includes a bottom area of the indoor space. That is, the first return air inlet 2 communicates with a lower space of the indoor space. In this way, even if cooking fume exists in the indoor space such as the kitchen, hot cooking fume is in the upper part of the indoor space. Air returning through the first return air inlet 2 located in the lower part of the indoor space can effectively prevent the cooking fume from entering the indoor unit body 1, thereby ensuring cleanliness of the indoor unit body 1, and prolonging the service life of the air conditioning system.

Further, the return air inlet further includes a second return air inlet 3 located in the upper part of the indoor space. That is, the second return air inlet 3 communicates with an upper space of the indoor space. The air conditioning system further includes a first switch device 4, and the first switch device 4 connects the cavity 100 to at least one of the first return air inlet 2 and the second return air inlet 3. That is, the first switch device 4 may be constructed not to connect the cavity 100 to the second return air inlet 3 when the cavity 100 is in communication with the first return air inlet 2, and not to communicate with the first return air inlet 2 when the cavity 100 is in communication with the second return air inlet 3. In some embodiments, the first switch device 4 is also constructed to connect the cavity 100 only to the first return air inlet 2, or only to the second return air inlet 3, or to both the first return air inlet 2 and the second return air inlet 3 at the same time, or to neither the first return air inlet 2 nor the second return air inlet 3. In this way, when the cooking fume exists in the indoor space, air returning through the first return air inlet 2 prevents the cooking fume from entering the indoor unit body 1, and when no cooking fume exists in the indoor space, and when the indoor unit body 1 operates for cooling, air returning through the second return air inlet 3 ensures cooling efficiency of the indoor unit body 1 for the indoor space (as cold air will sink, air returning through the first return air inlet 2 located at the lower part is not conducive to hot air returning to the indoor unit body 1 for heat exchange). It should be understood that, in some embodiments, when the indoor unit body 1 is operating for heating, air returning through the first return air inlet 2 also ensures a heating efficiency of the indoor unit body 1 for the indoor space (as hot air will float, air returning through the second return air inlet 3 located at the upper part is not conducive to cold air returning to the indoor unit body 1 for heat exchange).

In some embodiments, when the air conditioning system is applied to the kitchen, the first return air inlet 2 is arranged on a cabinet in the kitchen or on a wall adjacent to a floor of the kitchen, and the second return air inlet 3 can be arranged on a ceiling of the kitchen or on a wall adjacent to the ceiling, so as to ensure cleanliness of a space of the kitchen.

Further, in order to facilitate the arrangement of the return air inlet, In some embodiments, the air conditioning system further includes an air duct structure 5 communicating with an air inlet 11 of the cavity, and the return air inlet is arranged in the air duct structure 5, so that an arrangement of a position and an orientation of the indoor unit body 1 is more flexible. In some embodiments, the indoor unit body 1 is arranged vertically (referring to FIG. 3) or horizontally (referring to FIG. 2), and is disposed on the ceiling or in the cabinet. In some embodiments, a structure of the indoor unit body 1 is, for example, a ground mounted unit, and can be installed according to an actual situation, or is a household unit.

In some specific embodiments, the air duct structure 5 includes a main air duct portion 51 connected to the indoor unit body 1 and a plurality of branch air duct portions connected to the main air duct portion 51. The main air duct portion 51 and the branch air duct portions are a one-piece structure, or form a non-detachable connection by bonding, welding, etc., or form a detachable connection, such as a snap connection, a plug connection, a fastener connection, etc., so that it is convenient to disassemble the air duct structure. In a specific embodiment, a plurality of ports are provided in the main air duct portion 51, and the branch air duct portions are inserted into the ports respectively to realize connections between the main air duct portion 51 and the branch air duct portions. Further, each return air inlet is arranged at each of the branch air duct portions. For example, in the embodiment shown in FIG. 1, the plurality of branch air duct portions include a first branch air duct portion 52 and a second branch air duct portion 53. The first return air inlet 2 is arranged at the first branch air duct portion 52. Specifically, one end of the first branch air duct portion 52 is connected to the main air duct portion 51 through a first port 511, and the first return air inlet 2 is disposed at another end of the first branch air duct portion 52. The first return air inlet 2 is led to the lower part of the indoor space by the first branch air duct portion 52. The second return air inlet 3 is arranged at the second branch air duct portion 53. Specifically, one end of the second branch air duct portion 53 is connected to the main air duct portion 51 through a second port 512, and the second return air inlet 3 is disposed at another end of the second branch air duct portion 53. The second return air inlet 3 is led to the upper part of the indoor space by the second branch air duct portion 53. Of course, it should be understood that, in some embodiments, a plurality of return air inlets is also provided on a same branch air duct, and air returning through different positions is realized by blocking different return air inlets. In some embodiments, as shown in FIG. 1, the first branch air duct portion 52 and the second branch air duct portion 53 are arranged to extend in a vertical direction. Alternatively, the first branch air duct portion 52 or the second branch air duct portion 53 is arranged to extend in a vertical direction.

Since the indoor unit body 1 is usually disposed at the top area of the space or an upper area proximate to the top area of the space, a length of the first branch air duct 52 is relatively long. In order to save space, in some embodiments, the first branch air duct 52 is embedded in the wall.

Further, in some embodiments, the first switch device 4 is an air valve provided at the first return air inlet 2, the second return air inlet 3, or inside each branch air duct portion. To facilitate control, in some embodiments, the first switch device 4 is disposed in an inner cavity of the main air duct portion 51. In one embodiment, the first switch device 4 includes a first partition 41 arranged between the first port 511 and the second port 512, a first baffle 42 hinged to the first partition 41, and a first driving device (not shown in the figure) that drives the first baffle 42 to rotate. When the first baffle 42 rotates toward the first port 511 and abuts against a cavity wall between the first port 511 and the air inlet 11, the first baffle 42 disconnects the first port 511 from the air inlet 11, and the second port 512 communicates with the air inlet 11. At this time, the air returns through the second return air inlet 3. When the first baffle 42 rotates toward the second port 512 and abuts against a cavity wall between the second port 512 and the air inlet 11, the first baffle 42 disconnects the second port 512 from the air inlet 11, and the first port 511 communicates with the air inlet 11. At this time, the air returns through the first return air inlet 2.

Further, the air conditioning system also includes an exhaust duct 6 capable of connecting the second return air inlet 3 to outdoor space. In this way, the air in the indoor space is exhausted to outdoor space through the second return air inlet 3 and the exhaust duct 6. When cooking fume exists indoors, the cooking fume gathered near the ceiling is exhausted to outdoor space through the second return air inlet 3 and the exhaust duct 6, so as to effectively prevent the cooking fume from polluting the ceiling.

Further in some embodiments, the air conditioning system further includes an airflow driving device 7 driving the air in the indoor space to be exhausted to the outdoor space through the second return air inlet 3 and the exhaust duct 6. The airflow driving device 7 assists in exhausting the cooking fume, thereby enabling the cooking fume to be exhausted to the outdoor space as soon as possible, and further preventing the cooking fume from condensing on the ceiling. In some embodiments, the airflow driving device 7 is, for example, a fan arranged in the inner cavity of the second branch air duct portion 53 to provide a driving force as much as possible for a movement of the cooking fume.

Figure 2:
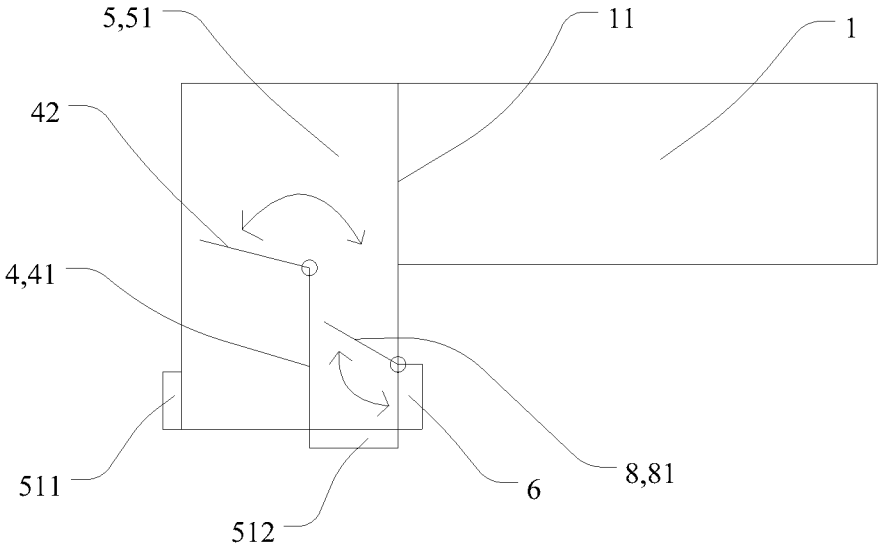
FIG. 2 is a first schematic structural diagram illustrating an indoor unit body and a main air duct portion according to an embodiment of the present disclosure.
Figure 3:
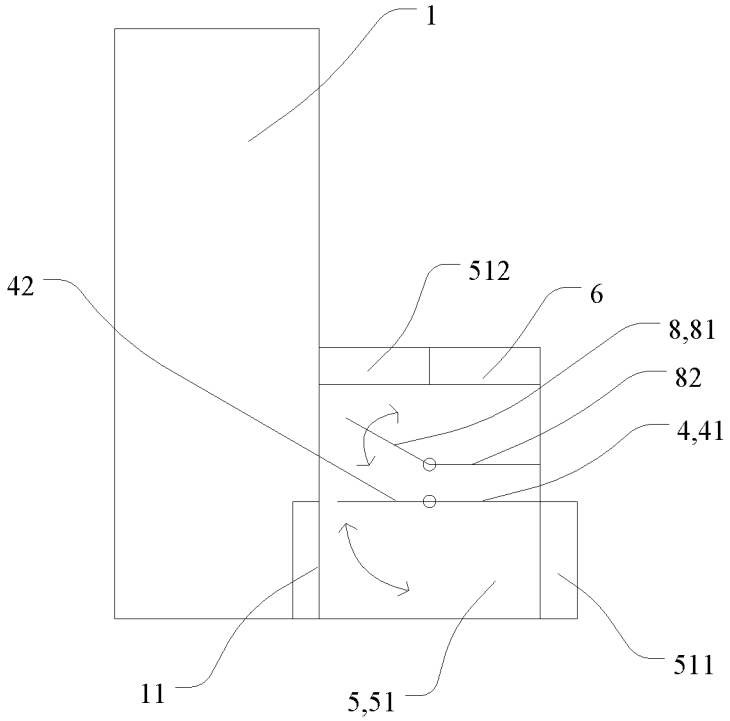
FIG. 3 is a second schematic structural diagram illustrating an indoor unit body and a main air duct portion according to an embodiment of the present disclosure.

Further, the air conditioning system further includes a second switch device 8. The second switch device 8 connects the exhaust duct 6 to the second return air inlet 3, or disconnects the exhaust duct 6 from the second return air inlet 3. The second switch device 8 may be, for example, an air valve. As shown in FIGS. 2 and 3, the second switch device 8 includes a second baffle 81 and a second driving device (not shown in the figure) that drives the second baffle 81 to rotate. As shown in FIG. 2, in some embodiments, the second baffle 81 is hinged to one side edge of the exhaust duct 6. When the second driving device drives the second baffle 81 to abut against another side edge, opposite to the one side edge, of the exhaust duct 6, the second baffle 81 closes the exhaust duct 6, and thus the second return air inlet 3 is not in communication with the exhaust duct 6. When the second driving device drives the second baffle 81 to abut against the first partition 41, the second baffle 81 opens the exhaust duct 6, and the second return air inlet 3 communicates with the exhaust duct 6, and the second return air inlet 3 is not communication with the air inlet 11. In another embodiment, as shown in FIG. 3, the second switch device 8 further includes a second partition 82. The second port 512 is arranged side by side with the exhaust duct 6, and the second partition 82 is disposed between the first partition 41 and the exhaust duct 6. One side edge of the second partition 82 is connected to one side cavity wall of the main air duct portion 51, and the second baffle 81 is hinged to another side edge, opposite to the one side edge, of the second partition 82. When the second baffle 81 abuts against a cavity wall between the second port 512 and the exhaust duct 6, the second baffle 81 closes the exhaust duct 6, and the second return air inlet 3 is not in communication with the exhaust duct 6. When the second baffle 81 abuts on another side cavity wall, opposite to the one side cavity wall, of the main air duct portion 51, the second baffle 81 connects the second return air inlet 3 with the exhaust duct 6, and the second return air inlet 3 is not in communication with the air inlet 11.

Further, a cooking fume detection device 9 is provided at the second return air inlet 3. In some embodiments, the cooking fume detection device 9 is arranged, for example, inside the second branch air duct portion 53. A detection value of the cooking fume detection device 9 is used to determine whether cooking fume exists in the indoor space, so as to perform a corresponding control. For example, when the detection value of the cooking fume detection device 9 is greater than or equal to a predetermined value, the first switch device 4 is controlled to connect the cavity 100 to the first return air inlet 2. In this case, the air returns to the indoor unit body 1 through the first return air inlet 2, thereby preventing excessive cooking fume from entering the indoor unit body 1. When the detection value of the cooking fume detecting device 9 is less than a predetermined value, and when the indoor unit body 1 is operating for cooling, the first switch device 4 is controlled to connect the cavity 100 to the second return air inlet 3, thereby ensuring cooling effect of the indoor unit body 1. When the detection value of the cooking fume detection device 9 is less than the predetermined value, and when the indoor unit body 1 is operating for heating, the first switch device 4 is controlled to connect the cavity 100 to the first return air inlet 2, thereby ensuring a heating effect of the indoor unit body 1.

Further, in some embodiments, when the detection value of the cooking fume detection device 9 is greater than or equal to the predetermined value, the exhaust duct 6 is opened so that the second return air inlet 3 is in communication with the outdoor space. At the same time, the airflow driving device 7 is started. In this way, the cooking fume ascending to the upper space is quickly exhausted to the outdoor space through the second return air inlet 3 and the exhaust duct 6, thereby ensuring the cleanliness of the ceiling.

The air conditioning system provided in the present disclosure is provided with a first return air inlet 2 located at the lower part of the indoor space. In this way, even if the cooking fume exists in the indoor space, the hot cooking fume is in the upper part of the indoor space. Air returning through the first return air inlet 2 located in the lower part of the indoor space effectively prevents the cooking fume from entering the indoor unit body 1, thereby ensuring cleanliness of the indoor unit body 1 and prolonging the service life of the air conditioning system.

It is easily understood by those skilled in the art that the above-mentioned preferred solutions can be freely combined and superimposed if no conflict occurs.

It should be understood that the above-mentioned embodiments are only exemplary but not restrictive. For those skilled in the art, various obvious or equivalent modifications or replacements can be made without departing from the basic principles of the present disclosure, and all these modifications or replacements will be within the scope of the claims of the present disclosure.

What is claimed is:

1. An air conditioning system for air conditioning of indoor space, comprising an indoor unit body, the indoor unit body comprising a cavity; the air conditioning system further comprises at least one return air inlet connecting the indoor space to the cavity, the at least one return air inlet comprising a first return air inlet; wherein the indoor unit body is located in an upper part of the indoor space, and the first return air inlet is located at a lower part of the indoor space;

the at least one return air inlet further comprises a second return air inlet located in the upper part of the indoor space, and the air conditioning system further comprises a first switch device, the first switch device connecting the cavity to at least one of the first return air inlet and the second return air inlet;

the first switch device comprises a first partition arranged between a first port and a second port and a first baffle hinged to the first partition; the first baffle is rotatable;

the air conditioning system further comprises an exhaust duct, and the exhaust duct connects the second return air inlet to an outdoor space;

the air conditioning system further comprises a second switch device, the second switch device comprises a second baffle, and the second baffle is rotatable and hinged to one side edge of the exhaust duct;

the second baffle is configured to: when driven to abut against another side edge of the exhaust duct opposite to the one side edge, the second baffle closes the exhaust duct so that the second return air inlet is not in communication with the exhaust duct; and when driven to abut against the first partition, the second baffle opens the exhaust duct so that the second return air inlet communicates with the exhaust duct, and that the second return air inlet is not communication with an air inlet; and the air conditioner system is further configured to communicate with only the second return air inlet during a cooling operation and communicate with only the first return air inlet during a heating operation.

2. The air conditioning system according to claim 1, wherein a cooking fume detection device is provided at the second return air inlet.

3. The air conditioning system according to claim 1, wherein the air conditioning system further comprises an airflow driving device, and the airflow driving device drives air in the indoor space to be exhausted to the outdoor space through the second return air outlet and the exhaust duct.

4. The air conditioning system according to claim 1, wherein an air inlet is provided in a cavity wall of the cavity; the air conditioning system further comprises an air duct structure communicating with the air inlet, and the first return air inlet and the second return air inlet are arranged on the air duct structure.

5. The air conditioning system according to claim 4, wherein the air duct structure comprises a main air duct portion connected to the indoor unit body, and a plurality of branch air duct portions connected to the main air duct portion, and the first return air inlet and the second return air inlet are arranged on the branch air duct portion.

6. The air conditioning system according to claim 5, wherein:

(i) (a) the first switch device is disposed in an inner cavity of the main air duct portion; and (b) the plurality of branch air duct portions comprise a first branch air duct portion and a second branch air duct portion, the first return air inlet being arranged on the first branch air duct portion, and the second return air inlet being arranged on the second branch air duct portion; or (ii) (a) the first switch device is disposed in an inner cavity of the main air duct portion; or (b) the plurality of branch air duct portions comprise a first branch air duct portion and a second branch air duct portion, the first return air inlet being arranged on the first branch air duct portion, and the second return air inlet being arranged on the second branch air duct portion.

7. The air conditioning system according to claim 6, wherein: (i) the first branch air duct portion and the second branch air duct portion are arranged to extend in a vertical direction, or (ii) the first branch air duct portion or the second branch air duct portion are arranged to extend in a vertical direction.

8. The air conditioning system according to claim 6, wherein the first branch air duct portion is arranged inside a wall, and the first return air inlet is exposed outside the wall.

9. The air conditioning system according to claim 5, wherein the plurality of branch air duct portions comprises a first branch air duct portion and a second branch air duct portion; one end of the first branch air duct portion is connected to the main air duct portion through a first port, and the first return air inlet is disposed at another end of the first branch air duct portion.

10. The air conditioning system according to claim 9, wherein one end of the second branch air duct portion is connected to the main air duct portion through a second port, and the second return air inlet is disposed at another end of the second branch air duct portion.

11. The air conditioning system according to claim 9, wherein a cooking fume detection device is provided at the second return air inlet, and the cooking fume detection device is arranged inside the second branch air duct portion.

12. The air conditioning system according to claim 1, wherein the air conditioning system is configured for air conditioning in a kitchen; the first return air inlet is arranged on a cabinet in the kitchen or arranged on a wall close to a floor of the kitchen; and the second return air inlet is arranged on a ceiling of the kitchen or on a wall adjacent to the ceiling.

13. A method for controlling the air conditioning system of claim 1, wherein a cooking fume detection device is provided at the second return air inlet, and the method comprises:

controlling the first switch device to allow the cavity to communicate only with the first return air inlet when a detection value of the cooking fume detection device is greater than or equal to a predetermined value; or, controlling the first switch device to allow the cavity to communicate only with the second return air inlet when a detection value of the cooking fume detection device is less than a predetermined value, and when the indoor unit body is operating for cooling; or, controlling the first switch device to allow the cavity to communicate only with the first return air inlet when a detection value of the cooking fume detection device is less than a predetermined value, and when the indoor unit body is operating for heating.

14. The method for controlling the air conditioning system according to claim 13, wherein the air conditioning system further comprises an exhaust duct, the exhaust duct connects the second return air inlet to an outdoor space, and the method comprises:

opening the exhaust duct to allow the second return air inlet to communicate with the outdoor space when the detection value of the cooking fume detection device is greater than or equal to the predetermined value.

* * * * *